US012213582B1

(12) United States Patent
Xu

(10) Patent No.: US 12,213,582 B1
(45) Date of Patent: Feb. 4, 2025

(54) COLLAPSIBLE ROTARY ELECTRIC CLEANING BRUSH

(71) Applicant: Chengting Xu, Guangdong (CN)

(72) Inventor: Chengting Xu, Guangdong (CN)

( * ) Notice: Subject to any disclaimer, the term of this patent is extended or adjusted under 35 U.S.C. 154(b) by 0 days.

(21) Appl. No.: 18/786,088

(22) Filed: Jul. 26, 2024

(30) Foreign Application Priority Data

Jul. 19, 2024 (CN) ..... 202421730011.0

(51) Int. Cl.
*A46B 13/02* (2006.01)
*A46B 5/00* (2006.01)
*A46B 13/00* (2006.01)

(52) U.S. Cl.
CPC ..... *A46B 13/02* (2013.01); *A46B 5/0041* (2013.01); *A46B 13/008* (2013.01); *A46B 2200/30* (2013.01)

(58) Field of Classification Search
CPC ..... A46B 13/02; A46B 5/002; A46B 5/0033; A46B 13/008; A47K 7/04
See application file for complete search history.

(56) References Cited

U.S. PATENT DOCUMENTS

2020/0001329 A1* 1/2020 Brennan ..... B08B 1/32

FOREIGN PATENT DOCUMENTS

CN 207785078 U * 8/2018
CN 218791070 U * 4/2023

* cited by examiner

*Primary Examiner* — Shay Karls

(57) ABSTRACT

The present application provides a collapsible rotary electric cleaning brush, including a handle assembly, a drive assembly, a rotary assembly, and a cleaning brush head assembly. The handle assembly is connected to the drive assembly. A collapsible rotary assembly is provided at the lower part of the drive assembly. A detachable rotary cleaning brush head assembly is provided at the bottom of the rotary assembly. The beneficial effect of the present application is that: the automatic cleaning and the collapsible rotation function can be performed, the cleaning brush head can be offset with the cleaning area, and the cleaning can be performed automatically. The operation is simple and labor-saving. The present application is equipped with a variety of brush heads, which can be replaced according to different use scenarios and cleaning areas. The cleaning effect is the best, and the replacement is simple and convenient.

7 Claims, 14 Drawing Sheets

COLLAPSIBLE ROTARY ELECTRIC CLEANING BRUSH

TECHNICAL FIELD

The present application relates to the technical field of cleaning tools, in particular to a collapsible rotary electric cleaning brush.

BACKGROUND OF THE PRESENT INVENTION

With the development of society, people's living standards are getting higher and higher, and the use of cleaning brushes is becoming more and more popular, especially electric cleaning brushes. As an electric cleaning tool, electric cleaning brush plays a very important role in production and life; it is widely used in industry, agriculture, tertiary industry and families and other well-known industries.

Electric rotary cleaning brush is a common cleaning brush. The brush head is fixed on the rotary head, and the motor drives it to rotate, so as to complete the cleaning of hard surfaces such as automobile wheels. Its multi-function is reflected in the fact that different brush heads can be installed and fixed, such as round sponge brush, cylindrical long brush, etc., to cope with the cleaning work of different areas, different requirements and different processes, so that an electric cleaning brush body can load multiple brush heads and realize its multi-functional function.

Different rotating heads need to be replaced during work, and special angles and positions need to be corresponded during installation, so the installation efficiency is low. When disassembling, it needs to be pulled out with relatively large force. At the same time, with the accumulation of disassembly and assembly times, the fixed structure of the rotating head is worn out, and the installed rotating head is easy to come out, resulting in the whole machine being unable to work.

Chinese patent CN218791070U discloses an electric rotary cleaning brush, which comprises a first handle, a power output head movably connected with the first handle and a quick-changing head detachably connected with the power output head, and is characterized in that the power output head and the quick-changing head are detachably connected with the quick-changing head through a disassembling device, and the disassembling device comprises a female socket arranged on the quick-changing head and a male socket connected on the power output head, so as to solve the problem that the quick-changing head can be quickly installed on the power output head by setting the male socket and the female socket to cooperate with each other. When disassembling, it is simple to pull out; the fixed structure of the quick-change head will not be worn, and the installation of the quick-change head will easily come out, resulting in the inability of the whole machine to work.

SUMMARY OF PRESENT INVENTION

The purpose of the present application is to solve the above technical problems and provide a new type of collapsible rotary electric cleaning brush, which can perform automatic cleaning and can be folded and rotated. The cleaning brush head can be balanced with the cleaning area, and can be cleaned automatically. The operation is simple and labor-saving. The present application is equipped with a variety of brush heads, which can be replaced according to different use scenarios and cleaning areas. The cleaning effect is the best, and the replacement is simple and convenient.

The present application is realized by the following technical solutions:

A collapsible rotary electric cleaning brush, comprising a handle assembly, a drive assembly, a rotary assembly, a cleaning brush head assembly, the handle assembly being connected to the drive assembly, the lower part of the drive assembly being provided with a collapsible rotary assembly, and the bottom of the rotary assembly being provided with a detachable rotary cleaning brush head assembly.

As further, the driving assembly comprises a driving shell, a driving main control circuit board, a driving battery, a driving connection shaft, a driving charging port, a driving starting button and a driving gear assembly, wherein the driving main control circuit board is provided inside the driving shell, a driving battery is provided above the driving main control circuit board, a driving battery is provided above the driving main control circuit board, a driving charging port, a driving starting button and a driving gear assembly, and the driving battery is electrically connected with the driving charging port and the driving starting button.

As further, the drive housing includes a left housing and a right housing, the bottom of the left housing is provided with a drive gear mounting hole, the right housing is internally provided with a cavity, the drive main control circuit board and the drive battery are installed in the cavity inside the right housing, the top of the right housing is provided with a connection shaft mounting hole, the bottom of the right housing is provided with a drive gear mounting position, the rear outer side wall of the right housing is provided with a charging port mounting groove, the front outer side wall of the right housing is provided with an activation key mounting position, the drive connecting shaft is embedded in the connection shaft mounting hole on the top of the right housing, the drive charging port is embedded in the charging of the rear outer side wall of the right housing in an electrical port mounting slot, the drive start button is mounted in a start button mounting position on a front outer side wall of the right housing.

As further, the drive gear assembly comprises a drive gear mounting plate, a drive gear, a drive gear connecting shaft, a drive gear cover plate, a drive gear support plate, the drive gear mounting plate is mounted in a drive gear mounting hole at the bottom of the left housing, the middle part of the drive gear mounting plate is provided with a gear mounting hole, the drive gear is embedded in the gear mounting hole in the middle of the drive gear mounting plate, one end of the drive gear connecting shaft is connected to the drive gear, the other end of the drive gear connecting shaft is connected to the drive gear cover plate, the drive gear cover plate seamlessly connects the drive gear mounting plate and the drive gear connecting shaft to the bottom of the left housing, the drive gear support plate is embedded in the drive gear mounting position at the bottom of the right housing, and the middle of the drive gear support plate is provided with a circular hole.

As further, the rotary assembly comprises a rotary left-side housing, a rotary right-side housing, a rotary gear, a rotary motor, a rotary motor bottom plate, a rotary connection assembly, the rotary left-side housing is sleeved on the rotary right-side housing, a cavity is formed between the rotary left-side housing and the rotary right-housing, a rotary motor is provided in the cavity, and is installed on the rotary motor bottom plate, a rotary motor bottom plate is provided between the bottom of the rotary left housing and the bottom of the rotary right housing, an output shaft hole is provided in the middle of the rotary motor bottom plate, the rotary left housing is installed on the drive gear, the top of the rotary right-side housing is provided with a rotary gear, the rotary gear is installed in a circular hole in the middle of the drive gear support plate, the output shaft of the rotary motor is connected with the rotary connection assembly, and the rotary left housing is seamlessly butted and fastened in the rotary right housing with a rotating gear and a rotating motor.

As further, the rotary connection assembly comprises a rotary connection bottom plate, a rotary connection mounting plate, and a rotary connection rod, the rotary connection mounting plate is installed inside the bottom plate of the rotary motor, the middle of the rotary connection mounting plate is provided with a through hole, one end of the rotary connection rod is connected with the rotary motor, and the other end of the rotary connection rod is connected with the cleaning brush head assembly.

As further, the cleaning brush head assembly comprises a cleaning brush head, a cleaning brush head bearing, the middle part of the cleaning brush head is provided with a bearing mounting position, the cleaning brush head bearing is embedded in the bearing mounting position of the middle part of the cleaning brush head, the cleaning brush head bearing is connected with the other end of the rotary connecting rod, and the cleaning brush head is locked on the rotary connecting rod.

As further, the handle assembly includes a handle connecting rod, a handle connecting shaft, a handle barrel, a handle locking piece, a handle, one end of the handle connecting rod is connected with the driving gear connecting shaft, the other end of the handle connecting rod is embedded in the handle barrel, the tail end of the handle is provided with an internal threaded base, the internal threaded base of the handle tail end is embedded in the handle barrel, and is connected with the other end of the handle connecting rod, and the handle locking piece locks the tail end of the handle in the handle barrel.

Further, the handle is a bent handle or a vertical handle.

Further, the top of the handle is provided with a lanyard.

Further, the bent handle is provided with a switch, which can control the work of the whole machine, and holding the bent handle is more convenient for a user to hold and clean.

The beneficial effects of the present application are that:

(1) It can carry out automatic cleaning and has folding and rotating functions, so that the cleaning brush head is abutted against the cleaning area, and can carry out automatic cleaning, has simple structure, simple operation and labor-saving use;

(2) This application is equipped with a variety of cleaning brush heads, which can be replaced according to different usage scenarios and cleaning areas. The cleaning effect is the best, and the replacement is simple and convenient;

(3) The internal motor and gear of the collapsible rotating electric cleaning brush are responsible for outputting rotational torque, driving the cleaning brush head to rotate for cleaning, and the cleaning brush head replaces different cleaning brush heads according to different environments;

(4) The top of the handle is equipped with a lanyard, which can hang the electric cleaning brush on the wall or hook, which does not take up space and is easy and convenient to replace.

Attachment markings: 1. Handle assembly; 11. handle connecting rod; 12. Handle connecting shaft; 13. Handle barrel; 14. Handle locking member; 15. Handle; 16. Switch; 17. Lanyard; 2. Drive assembly; 21. Drive housing; 210. Left housing; 2101 Drive gear mounting hole; 211. Right housing; 2110. Cavity; 2111. Connecting shaft mounting hole; 2112. Drive gear mounting position; 2113. Charging port mounting slot; 2114. Start button mounting position; 22. Drive main control circuit board; 23. Drive battery; 24. Drive connecting shaft; 25. Drive charging port; 26. Drive starting button; 27. Drive gear assembly; 270. Drive gear mounting plate; 271. Drive gear; 272. Drive gear connecting shaft; 273. Drive gear cover plate; 274. Drive gear support plate; 3. Rotary assembly; 31. Rotate left side housing; 32. Rotate right Side housing; 33, rotating gear; 34, rotating motor; 35, rotating motor base plate; 36, rotating connection assembly; 360, rotating connection base plate; 361, rotating connection mounting plate; 362, rotating connection rod; 4, cleaning brush head assembly; 41, cleaning brush head; 42, cleaning brush head bearing.

DETAILED DESCRIPTION OF THE EMBODIMENT'S

The present invention will be further described below with reference to the accompanying drawings and detailed description:

Unless otherwise defined, all technical and scientific terms used herein have the same meaning as commonly understood by those skilled in the art of the present application; The terminology used herein in the specification of the application is for the purpose of describing specific embodiments only, and is not intended to limit the application; The terms "comprising" and "having" and any variations thereof in the specification and claims of the present application and the above description of the drawings are intended to cover non-exclusive inclusions. The terms "first," "second," and the like in the specification and claims of the present application or the above-described drawings are used to distinguish different objects, and are not used to describe a specific order.

Reference herein to an "embodiment" means that a particular feature, structure, or characteristic described in connection with the embodiment may be included in at least one embodiment of the present application. The appearance of the phrase in various places in the specification does not necessarily refer to the same embodiment, nor is it an independent or alternative embodiment that is mutually exclusive from other embodiments. It is explicitly and implicitly understood by those skilled in the art that the embodiments described herein may be combined with other embodiments.

Figure 1:
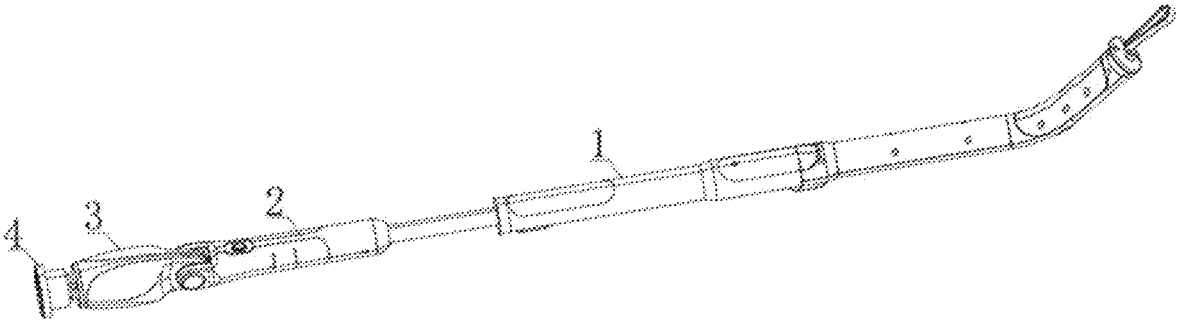
FIG. 1 is a schematic structural diagram of an embodiment of a collapsible Rotary Electric Cleaning Brush of the present application.
Figure 2:
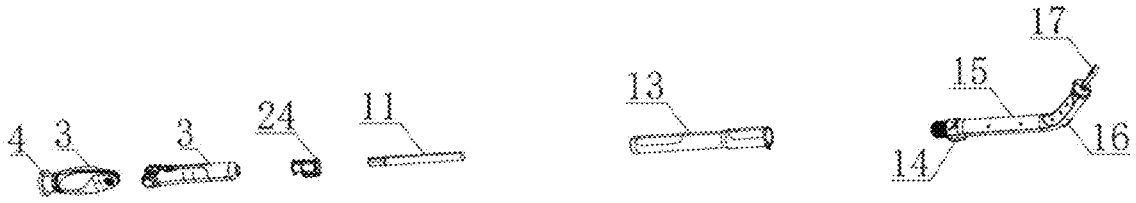
FIG. 2 is a schematic diagram of an explosive structure of an embodiment of the Collapsible Rotary Electric Cleaning Brush of the present application.
Figure 3:
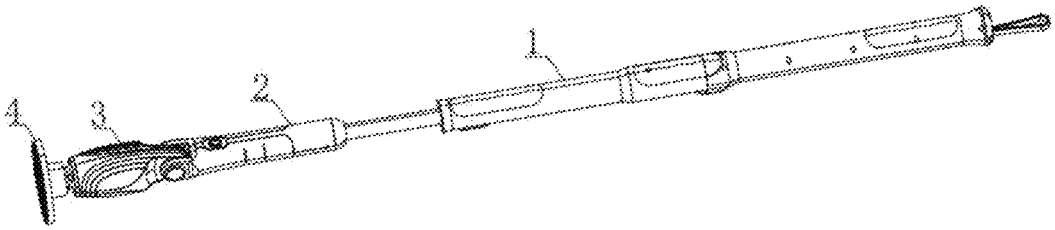
FIG. 3 is a schematic structural diagram of Embodiment 2 of the Collapsible Rotary Electric Cleaning Brush of the present application.
Figure 4:
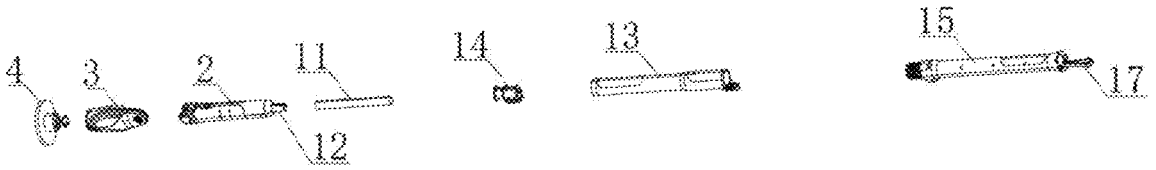
FIG. 4 is a schematic diagram of an explosion structure of a second embodiment of the Collapsible Rotary Electric Cleaning Brush of the present application.
Figure 5:
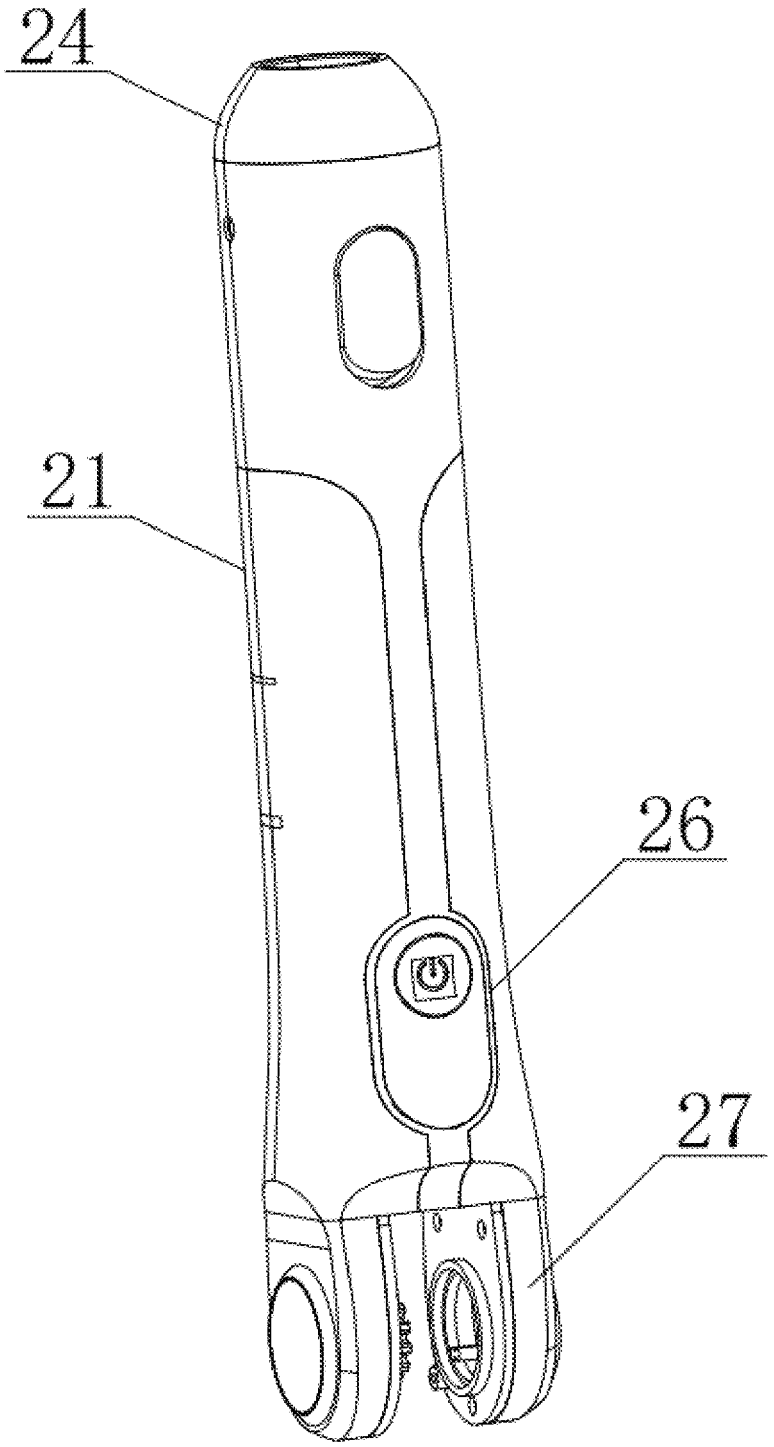
FIG. 5 is a schematic structural diagram of a drive assembly according to the present application.
Figure 6:
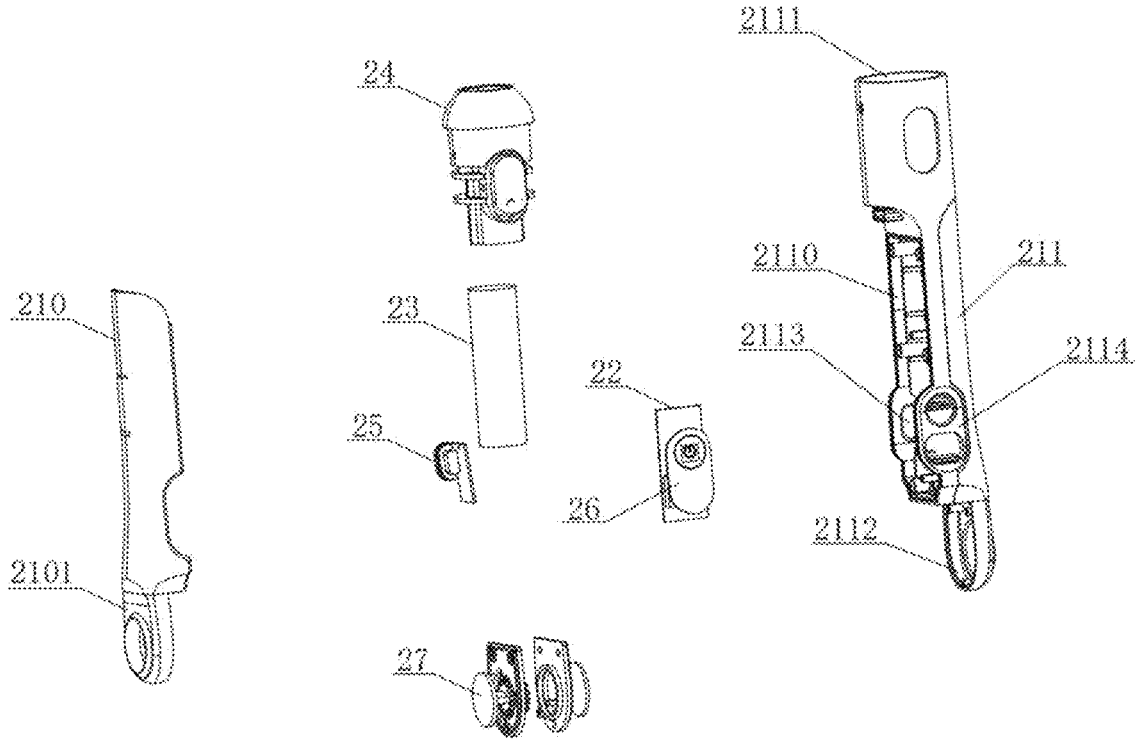
FIG. 6 is a schematic diagram of an explosion structure of a drive assembly according to the present application.
Figure 7:
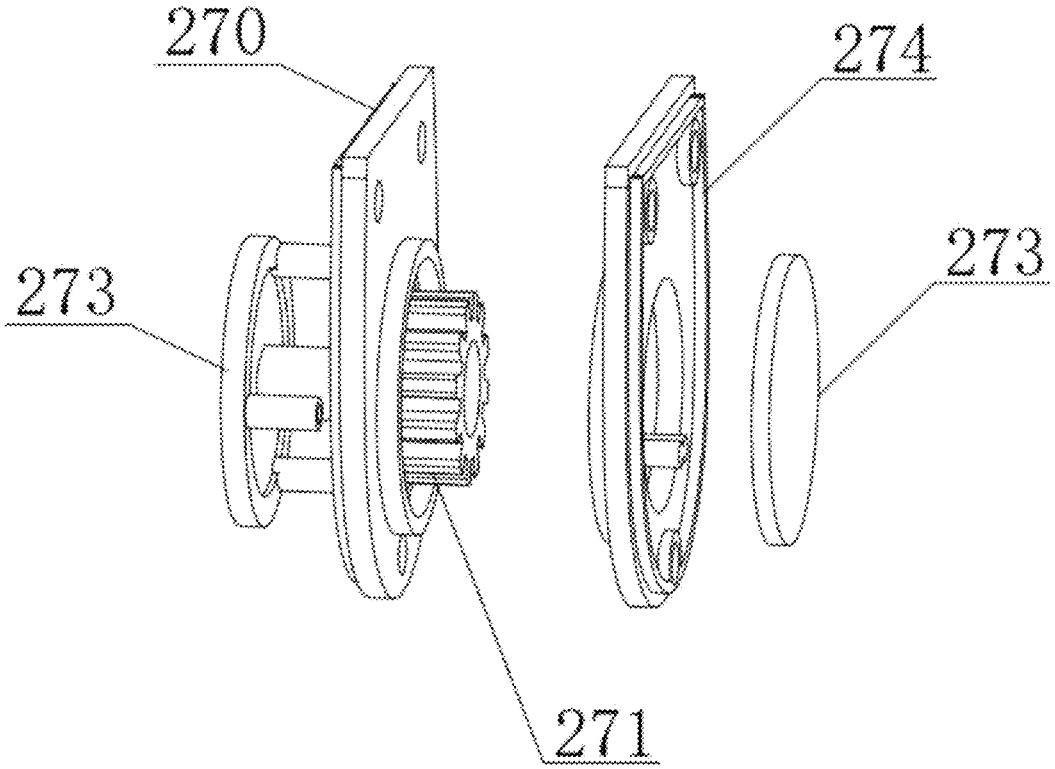
FIG. 7 is a schematic structural diagram of a drive gear assembly according to the present application.
Figure 8:
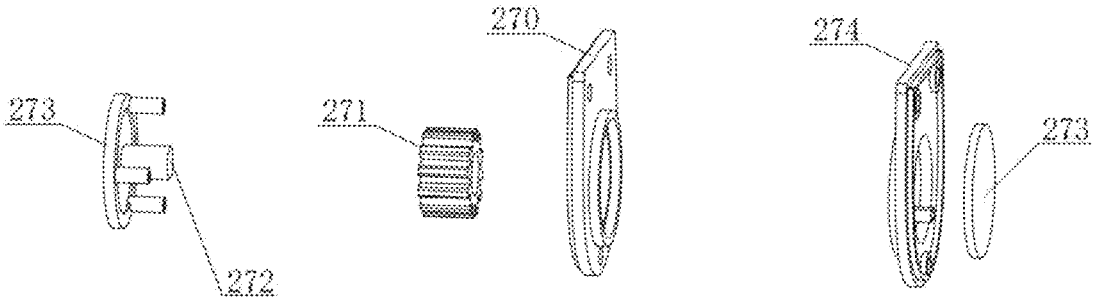
FIG. 8 is a schematic diagram of an explosion structure of a drive gear assembly according to the present application.
Figure 9:
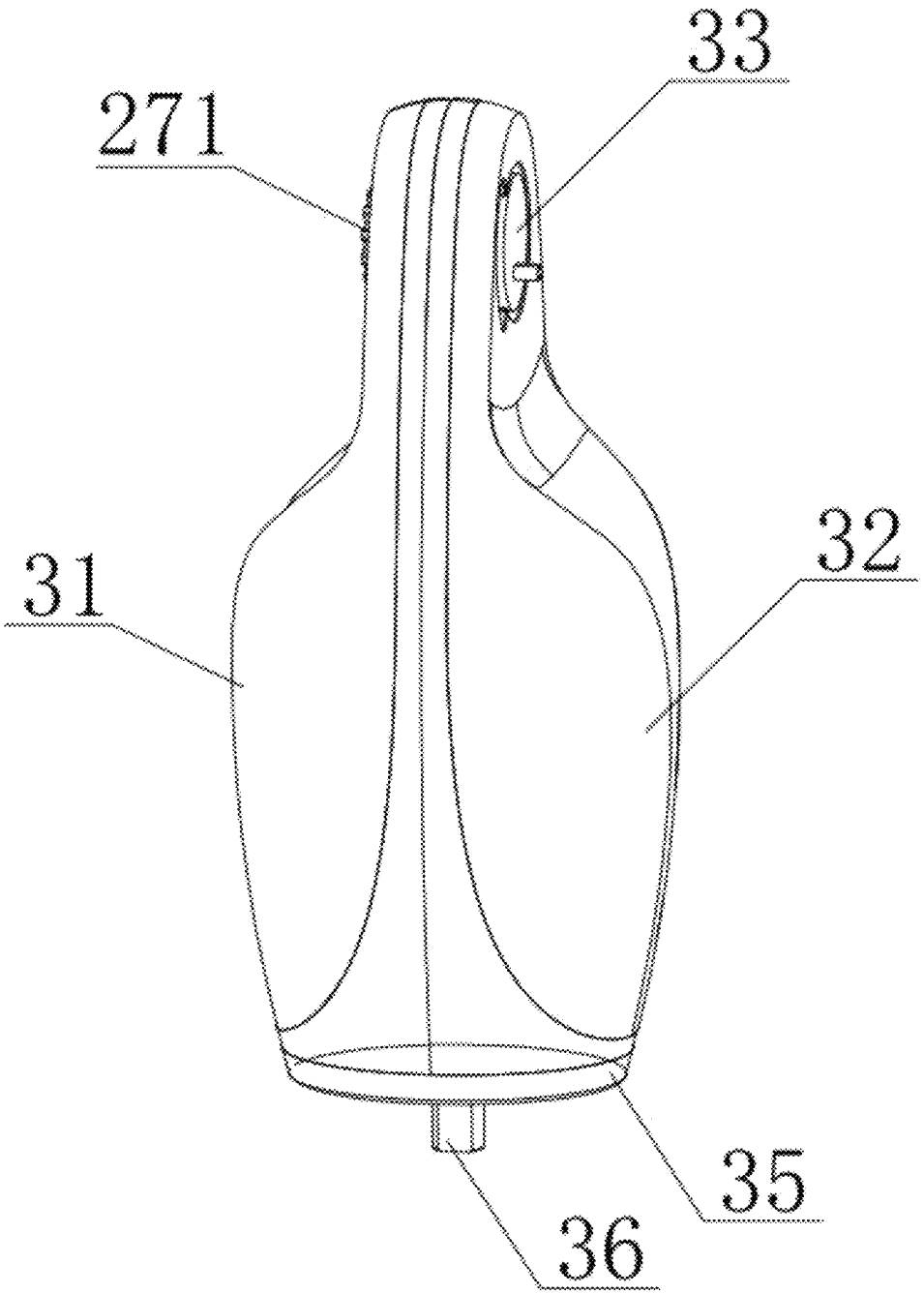
FIG. 9 is a schematic structural diagram of a rotating assembly according to the present application.
Figure 10:
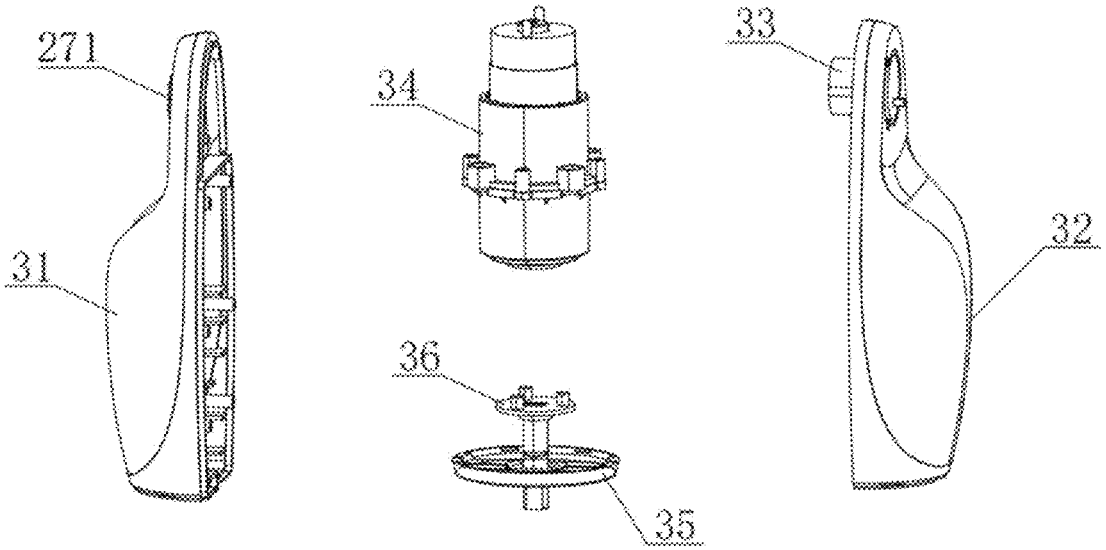
FIG. 10 is a schematic diagram of an explosion structure of a rotating assembly according to the present application.
Figure 11:
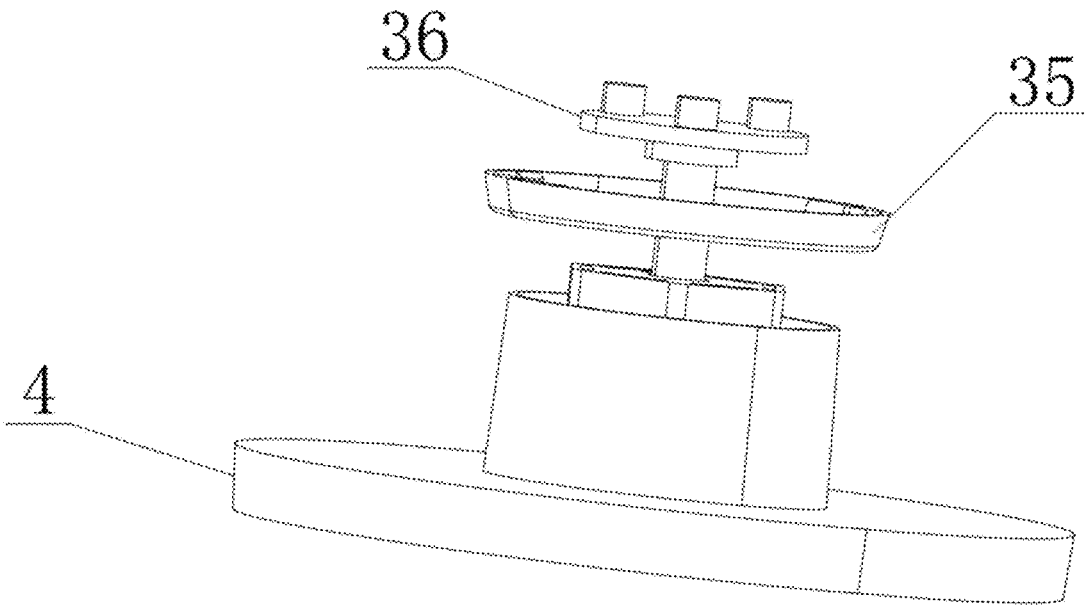
FIG. 11 is a schematic structural diagram of a rotary connection assembly and a cleaning brush head assembly of the present application.
Figure 12:
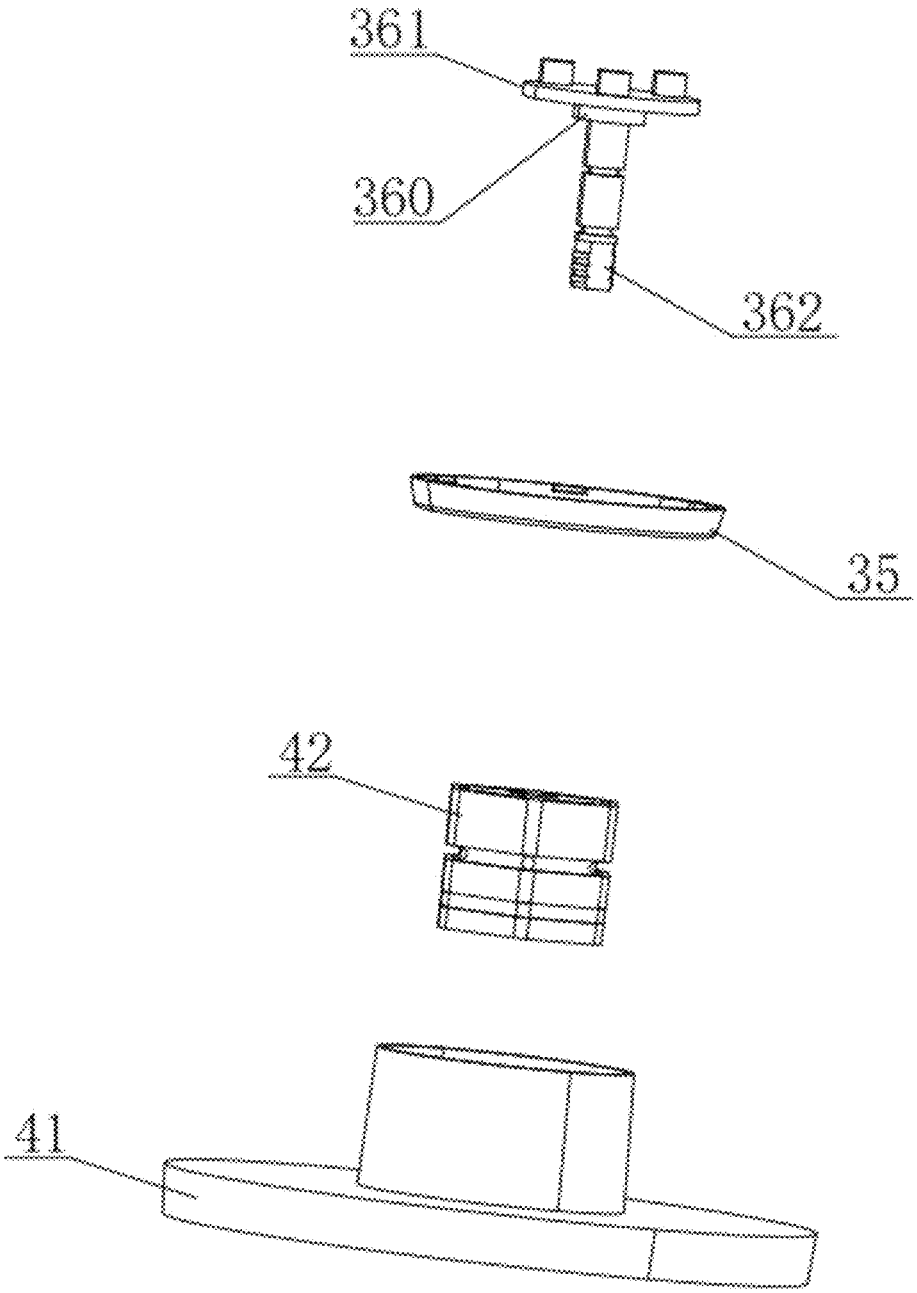
FIG. 12 is a schematic diagram of an explosion structure of a rotary connection assembly and a cleaning brush head assembly of the present application.
Figure 13:
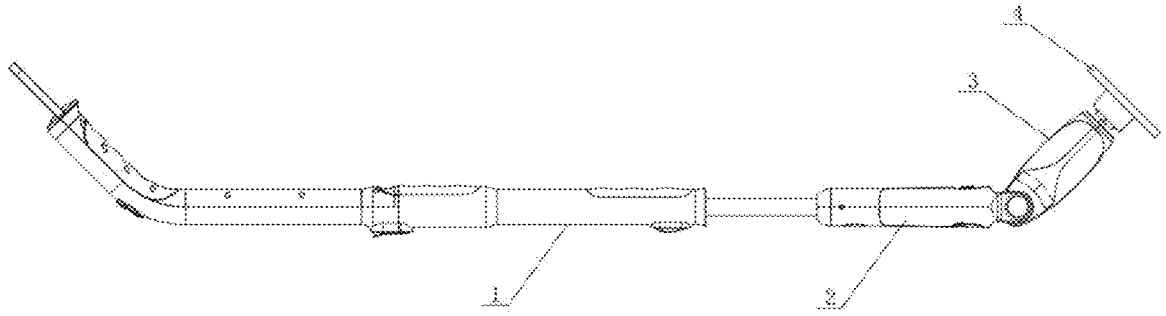
FIG. 13 is a schematic structural diagram showing a state in which the Collapsible Rotary Electric Cleaning Brush of the present application is in use according to Embodiment 1.
Figure 14:
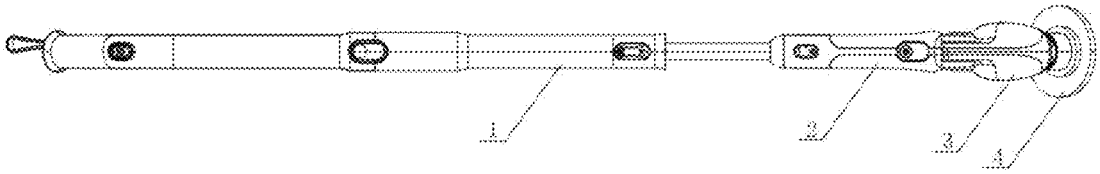
FIG. 14 is a schematic structural diagram of a second embodiment of the Collapsible Rotary Electric Cleaning Brush according to the present application in a state in use.

As shown in FIGS. 1-14, a collapsible rotating electric cleaning brush includes a handle assembly 1, a driving assembly 2, a rotating assembly 3, and a cleaning brush head assembly 4. The handle assembly 1 is connected with the driving assembly 2, the lower part of the driving assembly 2 is provided with a collapsible rotating assembly 3, and the bottom part of the rotating assembly 3 is provided with a detachable and rotatable cleaning brush head assembly 4. This structure features automatic cleaning and collapsible rotation capabilities, ensuring the cleaning brush head presses against the cleaning area for automatic cleaning. It can be replaced according to different usage scenarios and cleaning areas, achieving optimal cleaning effects with simple and convenient replacement procedures.

Preferably, the drive assembly 2 includes a drive housing 21, a drive main control circuit board 22, a drive battery 23, a drive connection shaft 24, a drive charging port 25, a drive start button 26, a drive gear assembly 27, the drive housing 21 is internally provided with a drive main control circuit board 22, the drive main control circuit board 22 is provided with a drive Battery 23, the top of the drive housing 21 is provided with a drive connection shaft 24, the back of the drive housing 21 is provided with a drive charging port 25, the front of the drive housing 21 is provided with a drive start button 26, the bottom of the drive housing 21 is provided with a drive gear assembly 27, the drive gear assembly 27 is movably connected with the rotary assembly 3, and can be folded for rotation Component 3, the drive connecting shaft 24 is connected to the handle assembly 1, the drive main control circuit board 22 is electrically connected to the drive battery 23, the drive main control circuit board 22 is electrically connected to the drive charging port 25, the drive start button 26, the drive gear assembly 27, the drive battery 23 is electrically connected to the drive charging port 25, and the drive start button 26, this structure is internally designed with motors and gears, mainly responsible for outputting rotational torque, driving the cleaning brush head to rotate for cleaning, cleaning brush head to replace different cleaning brush heads according to different environments.

Preferably, the drive housing 21 includes a left housing 210 and a right housing 211, the bottom of the left housing 210 is provided with a drive gear mounting hole 2101, the inside of the right housing 211 is provided with a cavity 2110, the drive main control circuit board 22 and the drive battery 23 are installed in the cavity 2110 inside the right housing 211, the top of the right housing 211 is provided with a connection shaft mounting hole 2111, the bottom of the right housing 211 is provided with a drive gear mounting position 2112, the bottom of the right housing 211 is provided with a drive gear mounting position 2113, the front outer side wall of the right housing 211 is provided with a start button mounting position 2114, and the front outer side wall of the right housing 211 is provided with a start button mounting position 2114.

Preferably, the drive gear assembly 27 includes a drive gear mounting plate 270 mounted in the drive gear mounting hole 2101 at the bottom of the left housing 210, a drive gear 271 mounted in the middle of the drive gear mounting plate 270, a drive gear connecting shaft 272, a drive gear cover plate 273, a drive gear support plate 274 mounted in the drive gear mounting hole 2101 at the bottom of the left housing 210, a hole, the drive gear 271 is embedded in a gear mounting hole in the middle of the drive gear mounting plate 270, one end of the drive gear connecting shaft 272 is connected to the drive gear 271, the other end of the drive gear connecting shaft 272 is connected to the drive gear cover plate 273, the drive gear cover plate 273 will drive the gear mounting plate 270, the drive gear 271 and The drive gear connecting shaft 272 is seamlessly engaged at the bottom of the left housing 210, the drive gear support plate 274 is embedded in the drive gear mounting position 2112 at the bottom of the right housing 211, and the middle of the drive gear support plate 274 is provided with a circular hole.

Preferably, the rotary assembly 3 includes a rotary left housing 31, a rotary right housing 32, a rotary gear 33, a rotary motor 34, a rotary motor bottom plate 35, a rotary connection assembly 36, the rotary left housing 31 is fitted on the rotary right housing 32, the rotary left housing 31 is connected with the rotary right housing A cavity is formed between the body 32, the cavity is provided with a rotating motor 34, and is installed on the rotating motor bottom plate 35, the rotating left side housing 31 is provided with a rotating motor bottom plate 35 between the bottom and the bottom of the rotating right side housing 32, the middle of the rotating motor bottom plate 35 is provided with an output shaft hole, the rotating left side housing 31 is installed on the drive On the gear 271, the top of the rotary right-side housing 32 is provided with a rotary gear 33 mounted in a circular hole in the middle of the drive gear support plate 274, the output shaft of the rotary motor 34 is connected to the rotary connection assembly 36, and the rotary left-side housing 31 seamlessly engages the rotary gear 33 and the rotary motor 34 in the rotary right-side housing 32.

Preferably, the rotary connection assembly 36 includes a rotary connection base plate 360, a rotary connection mounting plate 361, a rotary connection rod 362, the rotary connection mounting plate 360 is mounted inside the rotary motor base plate 35, a through hole is provided in the middle of the rotary connection mounting plate 361, one end of the rotary connection rod 362 is connected to the rotary motor 34 through the through hole in the middle of the rotary connection mounting plate 361, and the other end of the rotary connection rod 362 is connected to the cleaning brush head assembly 4.

Preferably, the cleaning brush head assembly 4 includes a cleaning brush head 41, a cleaning brush head bearing 42, the middle part of the cleaning brush head 41 is provided with a bearing mounting position, the cleaning brush head bearing 42 is embedded in the bearing mounting position of the middle part of the cleaning brush head 41, the cleaning brush head bearing 42 is connected to the other end of the rotary connecting rod 362, and the cleaning brush head 41 is locked to the rotary connecting rod 362.

Preferably, the handle assembly 1 includes a handle connecting rod 11, a handle connecting shaft 12, a handle barrel 13, a handle locking piece 14, a handle 15, one end of the handle connecting rod 11 is connected with the driving gear connecting shaft 272, the other end of the handle connecting rod 11 is embedded in the handle barrel 13, the tail end of the handle 15 is provided with an internal threaded base, the internal threaded base of the handle tail end 15 is embedded in the handle barrel 13, and is connected with the other end of the handle connecting rod 11, and the handle locking piece 14 locks the tail end of the handle 14 in the handle barrel 13.

Preferably, the handle 15 is a bent handle or a vertical handle.

(5) Preferably, the top of the handle 15 is provided with a lanyard 17, which can hang the electric cleaning brush on the wall or hook, does not occupy space and is simple and convenient to replace.

Preferably, the bent handle is provided with a switch 16, which can control the operation of the whole machine, and holding the bent handle is more convenient for a user to hold and clean.

According to the disclosure and teachings of the above specification, those skilled in the art to which the present application belongs can also make appropriate changes and modifications to the above-described embodiments. Therefore, the present application is not limited to the specific embodiments disclosed and described above, and some modifications and variations of the present application should also fall within the scope of protection of the claims of the present application. In addition, although some specific terms are used in this specification, these terms are for convenience of illustration only and do not limit the present application in any way.

What is claimed is:

1. A collapsible rotary electric cleaning brush, comprising, a handle assembly, a drive assembly, a rotary assembly, a cleaning brush head assembly, the handle assembly is connected to the drive assembly, the lower part of the drive assembly is provided with the rotary assembly, the bottom of the rotary assembly is provided with the rotary cleaning brush head assembly; the drive assembly includes a drive housing, a drive main control circuit board, a drive battery, a drive connecting shaft, a drive charging port, a drive starting button, a drive gear assembly, the drive housing is internally provided with the drive main control circuit board, the drive battery is disposed above the drive main control circuit board, the drive connecting shaft is disposed at the top of the drive housing, the drive charging port is disposed at the back of the drive housing, the front of the driving housing is provided with the drive start button, the bottom of the drive housing is provided with the drive gear assembly, the drive gear assembly is movably connected with the rotary assembly, the drive connecting shaft is connected with the handle assembly, the drive main control circuit board is electrically connected with the drive battery, the drive main control circuit board is electrically connected with the drive charging port, the drive start button, the drive gear assembly, and the drive battery is electrically connected with the drive charging port;

the drive housing includes a left housing and a right housing, the bottom of the left housing is provided with a drive gear mounting hole, the right housing is internally provided with a cavity, the drive main control circuit board and the drive battery are installed in the cavity inside the right housing, the top of the right housing is provided with a connection shaft mounting hole, the bottom of the right housing is provided with a drive gear mounting position, a rear outer side wall of the right housing is provided with a charging port mounting groove, a front outer side wall of the right housing is provided with an activation key mounting position, the drive connecting shaft is embedded in the connection shaft mounting hole on the top of the right housing, the drive charging port is embedded in the rear outer side wall of the right housing in an electrical port mounting slot, the drive start button is mounted in a start button mounting position on the front outer side wall of the right housing;

the drive gear assembly comprises a drive gear mounting plate, a drive gear, a drive gear connecting shaft, the drive gear cover plate, a drive gear support plate, the drive gear mounting plate is mounted in a drive gear mounting hole at the bottom of the left housing, the middle part of the drive gear mounting plate is provided with a gear mounting hole, the drive gear is embedded in the gear mounting hole in the middle of the drive gear mounting plate, one end of the drive gear connecting shaft is connected to the drive gear, the other end of the drive gear connecting shaft is connected to the drive gear cover plate, the drive gear cover plate seamlessly connects the drive gear mounting plate and the drive gear connecting shaft to the bottom of the left housing, the drive gear support plate is embedded in the drive gear mounting position at the bottom of the right housing, and the middle of the drive gear support plate is provided with a circular hole.

2. The collapsible rotary electric cleaning brush according to claim 1, characterized in that the rotary assembly comprises a rotary left-side housing, a rotary right-side housing, a rotary gear, a rotary motor, a rotary motor bottom plate, a rotary connection assembly, the rotary left-side housing is sleeved on the rotary right-side housing, a cavity is formed between the rotary left-side housing and the rotary right-housing, the rotary motor is provided in the cavity, and is installed on the rotary motor bottom plate, the rotary motor bottom plate is provided between the bottom of the rotary left housing and the bottom of the rotary right housing, an output shaft hole is provided in a middle of the rotary motor bottom plate, the rotary left housing is installed on the drive gear, a top of the rotary right-side housing is provided with the rotary gear, the rotary gear is installed in the circular hole in the middle of the drive gear support plate, the output shaft of the rotary motor is connected with the rotary connection assembly, and the rotary left housing is seamlessly butted and fastened in the rotary right housing with the rotating gear and the rotating motor.

3. The collapsible rotary electric cleaning brush according to claim 2, characterized in that: the rotary connection assembly comprises a rotary connection bottom plate, a rotary connection mounting plate, and a rotary connection rod, the rotary connection mounting plate is installed inside the bottom plate of the rotary motor, a middle of the rotary connection mounting plate is provided with a through hole, one end of the rotary connection rod is connected with the rotary motor, and the other end of the rotary connection rod is connected with the cleaning brush head assembly.

4. The collapsible rotary electric cleaning brush according to claim 3, characterized in that: the cleaning brush head assembly comprises a cleaning brush head, a cleaning brush head bearing, a middle part of the cleaning brush head is provided with a bearing mounting position, the cleaning brush head bearing is embedded in the bearing mounting position of the middle part of the cleaning brush head, the cleaning brush head bearing is connected with the other end of the rotary connecting rod, and the cleaning brush head is locked on the rotary connecting rod.

5. The collapsible rotary electric cleaning brush according to claim 1, characterized in that: the handle assembly comprises a handle connecting rod, a handle connecting shaft, a handle barrel, a handle locking piece, and a handle, one end of the handle connecting rod is connected with the driving gear connecting shaft, the other end of the handle connecting rod is embedded in the handle barrel, the tail end of the handle is provided with an internal threaded base, the internal threaded base of the handle tail end is embedded in the handle barrel and connected with the other end of the handle connecting rod, and the handle locking piece locks the tail end of the handle in the handle barrel.

6. The collapsible rotary electric cleaning brush according to claim 5, characterized in that the handle is a bent handle or a vertical handle.

7. The collapsible rotary electric cleaning brush according to claim 6, characterized in that the top of the handle is provided with a lanyard.

* * * * *